US007743518B2

(12) United States Patent
Khoshnood

(10) Patent No.: US 7,743,518 B2
(45) Date of Patent: Jun. 29, 2010

(54) PROGRAMMABLE SIGHT AND METHOD OF USE THEREOF

(76) Inventor: Bahram Khoshnood, 6935 Wakehurst Pl., Cumming, GA (US) 30040

( * ) Notice: Subject to any disclaimer, the term of this patent is extended or adjusted under 35 U.S.C. 154(b) by 0 days.

(21) Appl. No.: 11/967,777

(22) Filed: Dec. 31, 2007

(65) Prior Publication Data

US 2009/0165314 A1 Jul. 2, 2009

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS 3,163,937 A * 1/1965 Reynolds ..... 33/265
3,355,809 A * 12/1967 Guyton ..... 33/265
3,674,002 A * 7/1972 Diamond, Sr. ..... 33/265
3,766,656 A * 10/1973 Westphal ..... 33/265
4,020,560 A * 5/1977 Heck ..... 33/265
4,481,717 A * 11/1984 Kowalski ..... 33/265
4,617,741 A 10/1986 Bordeaux et al.
5,575,072 A 11/1996 Eldridge
5,914,775 A 6/1999 Hargrove et al.
5,941,226 A 8/1999 Marietta
6,073,352 A 6/2000 Zykan et al.
6,154,971 A * 12/2000 Perkins ..... 33/265
7,162,806 B1 * 1/2007 Swiggart ..... 33/265
7,255,035 B2 8/2007 Mowers
7,287,335 B2 * 10/2007 Yasuda et al. ..... 33/265
7,513,050 B2 4/2009 Kroening, Jr.

* cited by examiner

*Primary Examiner*—Christopher W Fulton
(74) *Attorney, Agent, or Firm*—Woodcock Washburn, LLP.

(57) ABSTRACT

A programmable bow sight having an adjustable sight pin and a display means adapted to display a value indicating a distance associated with the position of the sight pin is disclosed, wherein adjustment of the sight pin to a position where a value indicating a desired distance is displayed allows a user to accurately aim for a shot at the desired distance using the sight pin for elevation. The sight is programmable to alter the respective sight pin position(s) associated with one or more distance(s) to account for specific performance characteristics of a user's bow and/or arrow.

19 Claims, 3 Drawing Sheets

PROGRAMMABLE SIGHT AND METHOD OF USE THEREOF

TECHNICAL FIELD

The present invention relates generally to hunting and shooting sports, and, more specifically, to a programmable sight, particularly for an archery bow, and to methods of use thereof.

BACKGROUND OF THE INVENTION

For various reasons, including an extended hunting season, many hunters and shooters utilize archery weapons for at least a portion of their sporting time, and with much satisfaction. One source of frustration, however, involves the difficulty encountered by archers in appropriately adjusting their aim to account for the distance to a selected target. Particularly for hunting sports, where the archer must be successful on the first shot at a given distance, proper aiming adjustment to account for range is critical in achieving the desired result.

Traditionally, in order to provide aiming assistance for a number of different ranges, bow sights have been equipped with a number of pins, wherein each pin is associated with a selected range. When aiming, the archer may align the pin associated with the range of a selected target with such target to account for the ballistic trajectory of the arrow to the target. Unfortunately, however, such multiple pin arrangements necessarily suffer from the disadvantage of only being able to provide exact aiming assistance for targets at the exact distance associated with one of the pins; when a target is at a range between the ranges of two adjacent pins, the archer may not benefit from such precise aiming assistance. Furthermore, the number of pins that may be included is typically low, such as three or four. Accordingly, such sights fail to provide precise aiming assistance with a larger number of distances. In that regard, the addition of yet further pins becomes an impractical and poor solution, inasmuch as the additional pins tend to clutter the view through the sight aperture and/or interfere with the archers aim.

Another problem with such traditional pin assemblies, and one that is often encountered by those who use their archery weapons infrequently, is that the user may forget which distance is associated with each pin. Of course, this can be particularly problematic in an exited or stressful moment during a hunt or a shooting competition. Should the archer make a mistake regarding the distance associated with a given pin, a shot made in reliance thereon will almost certainly yield a poor result, i.e. the arrow traveling too far and over the intended target, or falling short and thus failing to reach the intended target.

As such, it is clear that there is an unmet need for a sight that provides continuous precise aiming assistance, wherein every resolvable range to a selected target includes an associated position of an aiming device, such as a sight pin, and that provides a clear display of the distance associate with a current position of such aiming device.

BRIEF SUMMARY OF THE INVENTION

Briefly described, in a preferred embodiment, the present invention overcomes the above-mentioned disadvantages and meets the recognized need for such an invention by providing a sight having a housing, mounting means for attaching the sight to a bow, and a single sight pin, such as a fiber optic sight pin. The position of the sight pin relative to the housing is adjustable via a user controlled adjustment device, such as a rotary knob, wherein a display device indicates the distance associated with the position of the sight pin based on an indication of sight pin position provided by a sight pin position sensor.

More specifically, the bow sight preferably includes a control means which is programmable in conjunction with at least one user input button and a measuring means for determining a vertical position of the sight pin relative to the sight housing. The control means may be formed as any suitable device, including electronic devices, such as an application specific integrated circuit (ASIC), a microprocessor, or the like, mounted on a printed circuit board, and a power supply, such as a battery. The control means is preferably operable to display a numeric value of a distance, such as in yards, associated with a sight pin position, as detected by the sensor, such as a rotary encoder, a linear resistive position sensor, an optical distance gauge, or the like. Thus, a user may rotate the knob to adjust the vertical position of the sight pin until the distance displayed on the display device matches the correct distance to a selected target (which correct distance may be obtained by conventional means, such as a rangefinder, a landmark, experience, or the like. The user may then use the sight pin to assist in aiming, for windage and/or for elevation.

The sight may be pre-programmed with distance values associated with each position of the sight pin, as measured relative to the sight housing, which values may be selected to approximate an accurate sighting position for associated distances using commonly-found bow characteristics. As such, a user may avoid, if desired, time-consuming calibration of the sight. If, on the other hand, the user desires precise calibration of the sight, especially when the user's bow characteristics vary from average or normal values (or the particular values selected as a basis for the preprogramming), the user may beneficially calibrate the sight to associate one or more distance values with the correct sight pin position for a selected bow and/or arrow.

In that regard, such calibration may beneficially be accomplished via manipulation of the sight pin position adjustment knob to cause a selected distance value to be displayed. The input button may then be manipulated to select a "programming" mode, whereafter further manipulation of the sight pin position adjustment knob may no longer alter the distance value displayed, but will continue to adjust the sight pin position. The user may then adjust the sight pin position to accurately reflect an accurate aiming position for the selected distance. The user may then preferably associate the accurate sight pin position with the selected distance. The user may then either end the calibration process by de-selecting the "programming" mode, wherein the control means may apply a default correlation of sight pin position adjustment to distance displayed.

Alternatively, and preferably for more precise sighting, the user may select a second distance and repeat the steps described above for associating the second distance with a second sight pin position. Such association of sight pin position with selected distances may be repeated, as desired, by the user for as many distances as the user wishes, whereby if desired, each distance increment may be associated with a user-selected sight pin position. Alternatively, however, and preferably for convenience, the user may select the accurate sight pin position and associate same with a corresponding distance for only a relatively small number of distances, such as increments of 10 distance unit: for example, at 10 yards, 20 yards, 30 yards, etc. The control means may then preferably automatically associate the remaining distance values with accurate sight pin positions based on the user-defined sight pin positions for one or more distance value(s) and a predetermined distance prediction program.

Accordingly, one feature and advantage of the present invention is its ability to provide a single adjustable sight pin, whereby clutter and duplicative parts may be avoided, and whereby confusion or error in sight pin selection may be avoided during use.

Another feature and advantage of the present invention is its ability to provide a distance display whereby user confusion regarding the distance associated with a selected sight pin position may be avoided.

Still another feature and advantage of the present invention is its ability to simplify a calibration process of the sight by predicting one or more sight pin position/distance association (s) based on one or more user-defined sight pin position/distance association(s).

These and other features and advantages of the present invention will become more apparent to those ordinarily skilled in the art after reading the following Detailed Description of the Invention and Claims in light of the accompanying drawings.

BRIEF DESCRIPTION OF THE DRAWINGS

Accordingly, the present invention will be understood best through consideration of, and with reference to, the following drawings, viewed in conjunction with the Detailed Description of the Invention referring thereto, in which like reference numbers throughout the various Figures designate like structure, and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE INVENTION

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

Figure 1:
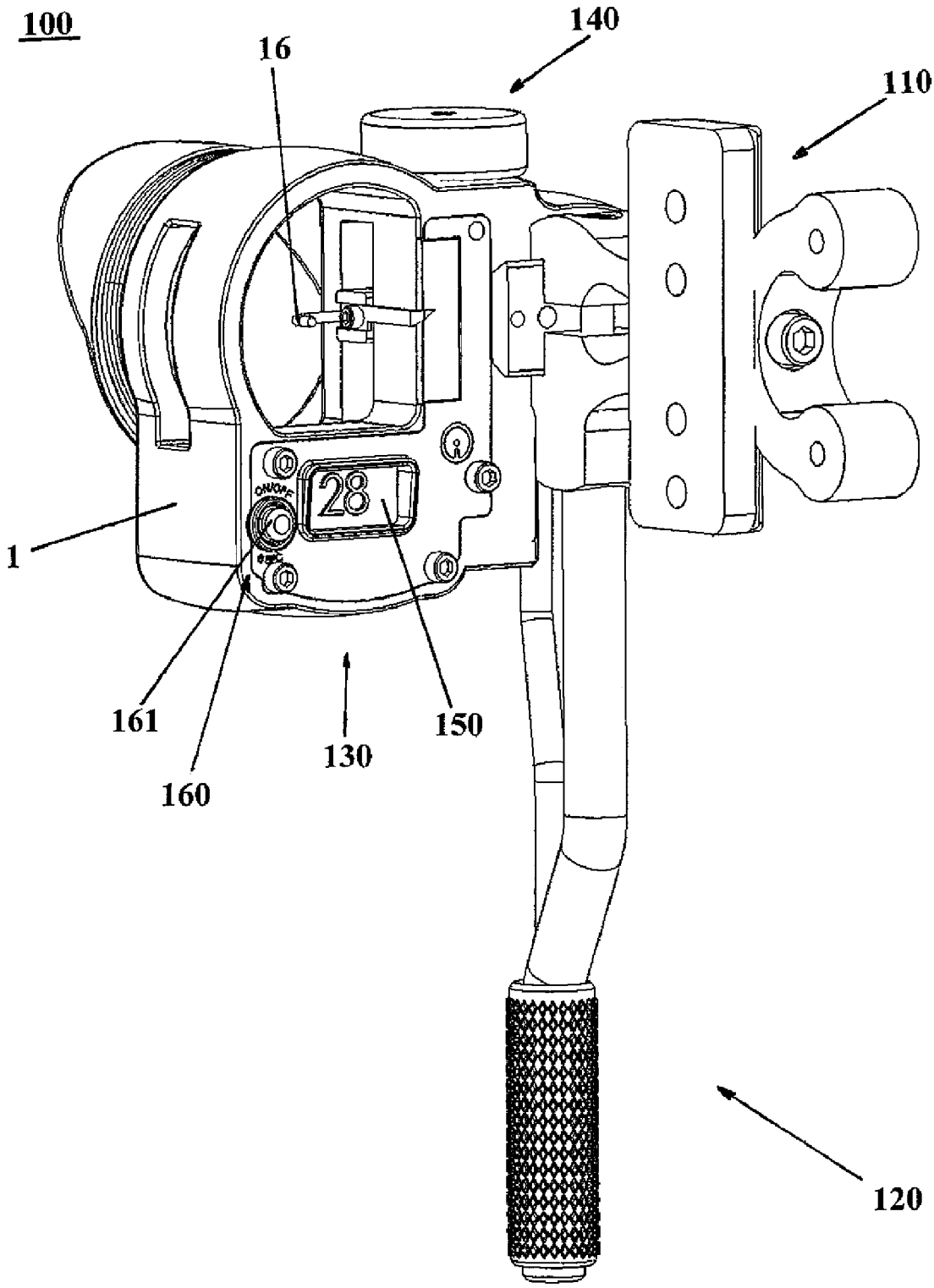
FIG. 1 is a perspective view of a sight according to the present invention.
Figure 2:
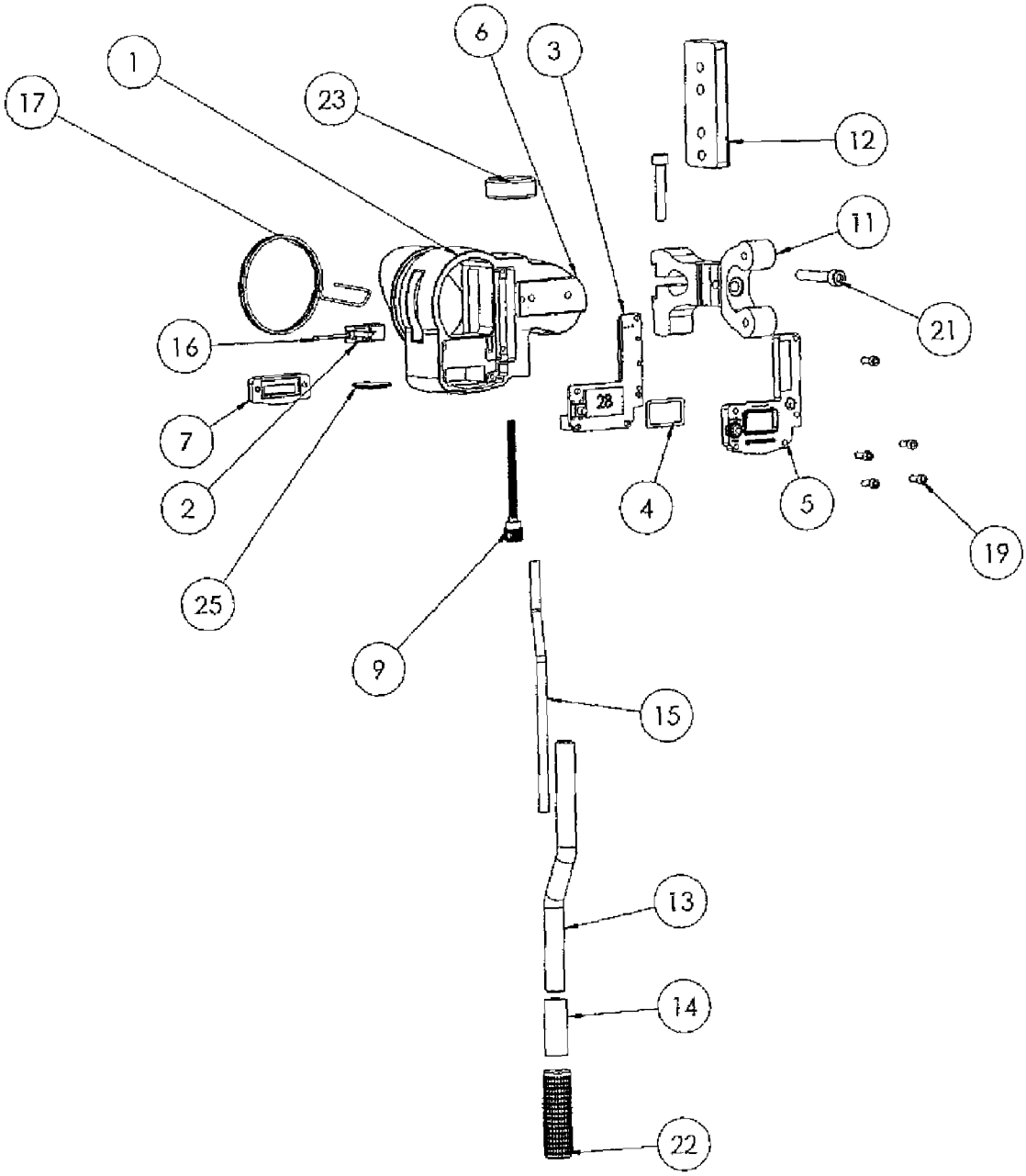
FIG. 2 is an exploded view of the sight of FIG. 1.
Figure 3:
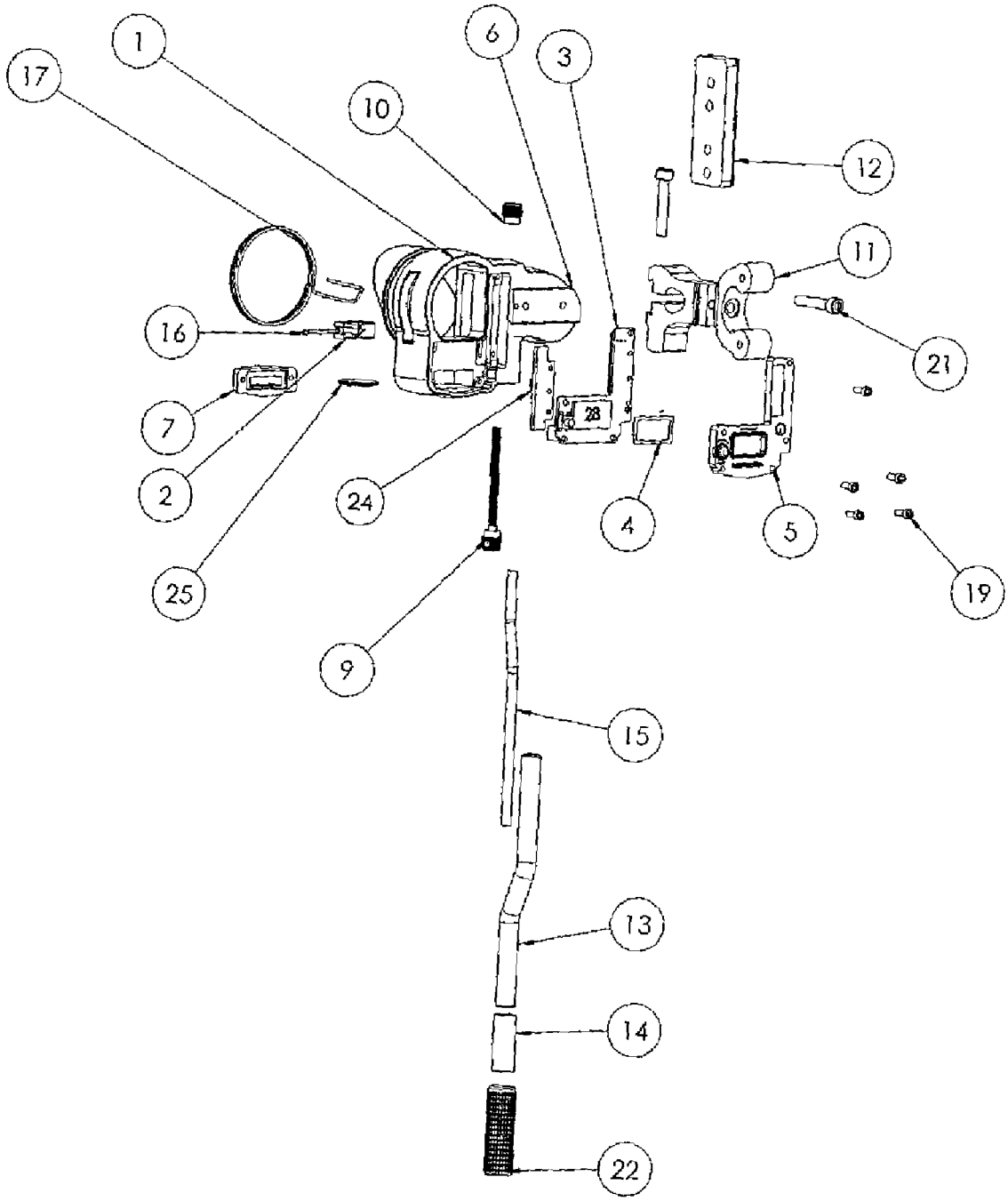
FIG. 3 is an exploded view of a sight according to an alternative embodiment.

In that form of the preferred embodiment of the present invention chosen for purposes of illustration, FIGS. 1-3 show sight 100 including housing 1, mounting means 110, sight pin 16, adjustment means 120 for adjusting a vertical position of sight pin 16 relative to housing 1, control means 130, and sight pin position detection means 140.

More specifically, housing 1 may be formed of any suitable durable material, such as a lightweight metal, e.g. magnesium, aluminum, or the like, a plastic material, a composite, a ceramic, or other suitable material. Housing 1 is preferably designed to house and/or carry each of mounting means 110, sight pin 16, adjustment means 120, control means 130, and sight pin detection means 140, and to protect such components from physical damage, water damage, dirt, and the like. For example, mounting means 110 comprising extension bracket 11, clamping screws 21, elevation block 12, and windage bar 6, preferably facilitates secure and adjustable attachment of housing 1 to a bow (not shown), whereby a vertical and horizontal position of housing 1 may be adjusted relative to the bow as desired and/or to calibrate housing 1, and sight pin 16 carried thereby, such as for windage.

Housing 1 is preferably further adapted to receive adjustment means 120, including flexible cable 15 adapted to engage lead screw 9 for adjusting a position of sight pin 16, as discussed in greater detail below, flexible cable holder 13, knob 22, and bushing 14. Flexible cable holder 13 preferably secures knob 22 in operable engagement with lead screw 9, and preferably disposes knob 22 in a selected location where knob 22 may be easily accessed and manipulated by a hand of a user holding the bow. Thus, little or no noticeable movement of the user's body or hands is required to adjust the position of sight pin 16 as desired.

To accommodate different users, flexible cable holder 13 preferably exhibits "memory", i.e. is flexible but retains a position and/or orientation once adjusted by a user, such as by bending. Flexible cable 15 preferably conforms to the position and/or orientation of flexible cable holder 13 and does not interfere with adjustment thereof. While being flexible along a longitudinal axis, flexible cable preferably substantially resists twisting about the longitudinal axis, wherein a torque applied to a distal end thereof by knob 22 may preferably be transferred to lead screw 9 at a proximal end thereof.

Housing 1 is preferably further adapted to receive sight pin 16 preferably carried by pin block 2, and is operable with fiber optic 17 to provide a pin-point light source at a tip of sight pin 16, as is known in the art, via ambient light collection, an LED, or the like. Sight pin 16 is preferably adjusted relative to housing 1 via operable engagement of pin block 2 with adjustment means 120. Specifically, pin block 2 is preferably raised and lowered via rotation of lead screw 9. As discussed above, rotation of lead screw 9 is preferably accomplished via manipulation of knob 22. In the embodiment of FIGS. 1 and 2, sight pin position detection means 140 is formed as rotary encoder 23, wherein a number of rotations, including fractions thereof, are preferably detected. Rotary encoder 23 is preferably operable with control means 130 to convert a number of rotations to a change in vertical position of sight pin 16 relative to housing 1, such as based on the number of threads per distance unit of lead screw 9.

As will be understood in the art, many other types of position sensors may be used to provide an indication of sight pin position to control means 130 without departing from the scope and spirit of the present invention, such as electrical resistance position sensors, optical position sensors, magnetic position sensors, or the like. For example, and as illustrated in FIG. 3, sight pin position detection means 140 is formed as linear position sensor 24 and includes bearing 10 operable with lead screw 9. Linear position sensor 24 is preferably formed as a variable resistor securely mounted on circuit board 3 (or housing 1) having a lead attached to pin block 2, wherein motion of pin block 2 causes a voltage drop across linear position sensor 24 to vary.

As will further be understood, knob 22 may be replaced by one or more button(s), switch(es) or the like, operable to selectively activate a motor, an actuator, or the like, which may be used to adjust a position of sight pin 16 relative to housing 1, either through sight pin block 2 and lead screw 9, or via alternative means, such as via a cable, chain, piston, gear, or the like. Similarly, mounting means 110 may comprise one or more button(s), switch(es), or the like, operable to control one or more motor, actuator, or the like, to selectively adjust a position of bow sight 100 relative to a bow, or the like.

Control means 130 is preferably formed as circuit board 3 having one or more processor(s), memory chip(s), and the like operable to causes display means 150, such as an LCD display, an LED display, a speaker, or the like, to provide a visual and/or audio indication of a distance associated with the detected position of sight pin 16, such as a range to a target. The indication may take any desired form, such as numerals, letters, symbols, patterns, or the like, so long as each indication may be understood by a user to indicate an associated distance, such as a range to a target in yards. Control means 130 preferably further includes battery 25 retained in housing 1 and secured via battery cover 7. Circuit board 3 is preferably likewise retained in housing 1 and secured via gasket 4 and cover 5, operable with mounting screws 19. Sight 100 may preferably be "pre-set," i.e. having a predefined distance associated with a plurality of sight pin positions, such as each detectable sight pin position. In order to calibrate sight 100, such default distance associations may be altered. For example, a user may initiate a "programming" mode of control means 130 via input means 160, such as one or more button(s), switch(es), knob(s), combinations thereof, or the like. According to one embodiment, a single button 161 may be included for mode selection and for calibration of sight 100.

As discussed above, sight 100 may be pre-programmed by associating one or more sight pin position(s) with one or more respective distance value(s). Remaining sight pin positions may automatically be associated with respective distances via a predetermined equation, or, alternatively, each sight pin position may be associated with a respective distance manually by a user before use. Preferably, such pre-programming is performed before acquisition of the sight by an end-user thereof, e.g. during manufacture thereof. In a simple example, control means 130 may simply divide the distance between two-user-selected sight pin positions by the number of incremental distance values between the distance values associated with the user-selected sight pin positions, and thereafter associate each of the undefined values with sight pin positions using an equal spacing of sight pin positions between the two user-defined sight pin positions. For example, after storing respective sight pin position/distance associations for 10 yard and for 20 yard distance values, an exemplary process for which is described in greater detail below, control means 130 may automatically associate each incremental distance value therebetween, i.e. values for yards 11-19, with 9 respective evenly spaced sight pin positions between the stored sight pin positions. Furthermore, control means 130 may optionally associated each sight pin position of equal spacing to distance values greater than and/or less than the distances having stored associations.

As will be understood by those skilled in the art, however, such even spacing of sight pin positions with distances between user-defined sight pin positions will not provide as precise pin position/distance associations as user-defined associations due to the failure of such an "even increment" model to conform to reality. Thus, in order to improve accuracy, the control means may utilize a more complicated distance prediction program that accounts more accurately for the effects of ballistic trajectory, including wind resistance and the like, on aiming elevation as range increases or decreases. Using such an improved prediction program, a single user-defined sight pin position/distance association may be sufficient to generate and store accurate sight pin position values with each incremental distance value.

Nonetheless, a user may wish to calibrate and/or recalibrate sight 100 for accurate aiming when used with a particular bow, having associated characteristics, such as arrow velocity, draw force, arrow spin, arrow shaft rigidity, arrow drag, or the like, that differ from those presumed in the distance prediction program of control means 130. As another alternative, the distance prediction program of control means 130 may be customized based on bow and/or arrow performance characteristics provided by a user that match those of a bow and arrow combination to be used with sight 100. Such customization of the distance prediction program may afford a user with both ease of calibration, i.e. only having to verify a single sight pin position/distance association (an exemplary process for which is discussed in greater detail below), and with accurate prediction of default or pre-programmed pin position/distance associations.

In use, sight 100 is preferably mounted to a bow, such as via mounting means 110. Once mounted, sight 100 may preferably be adjusted for windage (i.e. to center sight pin 16 to accurately indicate a line of flight of an arrow), such as via windage bar 6 and an associated clamping screw 21. Once such windage adjustment has been completed, control means 130 may be activated, or turned "on", by manipulation of input means 160, such as pressing and holding button 161 for a predetermined amount of time, such as 6 seconds, wherein control means 130 preferably enters a "run" mode. Once activated, a value is preferably displayed in a first format, such as solid (i.e. not blinking). The user may then preferably manipulate adjustment means 120 to vary a vertical position of sight pin 16 until a predetermined value is displayed by display means 150, such as a value associated with a distance of 10 yards. A position of sight 100 relative to the bow may then preferably be adjusted via mounting means 120, such as via elevation block 12 and an associated clamping screw 21, until the default sight pin position associated with the predetermined distance accurately indicates the proper elevation for a shot at the distance associated with the predetermined value, i.e. 10 yards according to the example provided above.

After such vertical and horizontal position adjustments of sight 100 relative to the bow have been completed, the accuracy of one or more pre-programmed distance/sight pin position association(s) may be verified in order to ensure that the pre-programmed associations are accurate in use with the particular bow performance characteristics and/or performance characteristics of a selected arrow. Such verification may preferably be accomplished by manipulation of adjustment means 120, while control means 130 is operating in the "run" mode, until a selected second value is displayed on display means 150, such as a value indicating a distance of 20 yards. The pin position associated with the selected second value may preferably be tested via comparison with one or more test shot(s) at the distance associated with the selected second value. If accurate, the calibration may be completed, whereafter sight 100 may be relied upon for accurate sighting at all distances via respective default or pre-programmed sight pin positions associated therewith. Sight 100 may be used immediately, or may be turned "off" by manipulation of input means 160, or the like, such as by pressing and holding button 161 for 6 seconds, or another pre-programmed "press-and-hold" termination time. The respective pin position/distance associations are preferably stored, such as in a memory of control means 130.

If, however, the default or pre-programmed sight pin position associated with the selected second value is not accurate for the one or more test shot(s) at the distance associated with the selected second value, then the sight pin position associated with the selected second value may be adjusted via selection of a "programming" mode of control means 130. Such "programming" mode may preferably be selected via manipulation of input means 160, such as by pressing and holding button 161 for 3 seconds, then releasing button 161 (i.e. to prevent turning control means 130 "off"). The selected second value may then preferably be displayed in a second format indicating that the "programming" mode has been selected, such as by flashing for ½ second intervals, or the like. The sight pin position may then preferably be adjusted in the "programming" mode via manipulation of adjustment means 120, wherein the value displayed on display means 150 may not change during such adjustment of the sight pin position. When a sight pin position has been selected that accurately indicates the proper elevation for one or more test shot(s) performed at the distance associated with the selected second value, an association of such sight pin position with the selected second value may be stored, again in a memory of control means 130 via manipulation of input means 160, such as by pressing and holding button 161 for 3 seconds, to exit the "programming" mode and select the "run" mode.

Confirmation of accurate sighting at one or more additional selected distance(s) is achieved via manipulation of adjustment means 120 until a value associated with such distance is displayed on display means 150, and via comparison of a sight pin position associated with such value with one or more test shot(s) taken at the additional selected distance(s). Inaccurate sight pin positions may preferably be corrected via the process described above for one or more of such additional distance(s). Control means 130 may additionally include other features, such as a calibration error prevention feature. As will be understood by those skilled in the art, if a difference in sight pin position between respective sight pin positions associated with two distance values, such as values associated with 10 and 20 yards, is X, then the difference in sight pin position between respective sight pin positions associated with two greater distance values, such two greater distance values having the same difference as the first two distance values, e.g. 20 and 30, should be greater than X. Thus, in order to prevent a user from associating a sight pin position with a selected distance value that is too close to the sight pin position associated with another distance, control means 130 may clear all existing stored sight pin position/distance associations when a sight pin position/distance association is stored by a user that conflicts with the existing stored associations. The user may then complete the calibration process for as many distances as desired, assuming no more conflicting sight pin position/distance associations are stored. In order to reduce the likelihood of a user storing such conflicting sight pin position/distance associations, control means 130 may only allow user calibration of sight pin position for selected distances, wherein such distances are sufficiently far apart. For example, control means 130 may allow a user to calibrate the sight pin position only for distance values associated with 10 yards, 20 yards, 30 yards, etc., or the like. These values may be used because it is unlikely that any slight error in calibration would result in a sight pin position being associated with a respective distance value that violates the rule expressed above, i.e. a sight pin position that is too close to the sight pin position associated with another distance value. For example, it is very unlikely that the distance between sight pin positions associated with 20 and 30 yards, respectively, will be less than the distance between sight pin positions associated with 10 and 20 yards, even if one or more of the associated pin position(s) is(are) not perfectly set.

Having thus described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is at least:

1. A sight for use in combination with an archery weapon comprising:

a housing;

a sight pin, wherein the position of the sight pin relative to the housing is adjustable;

detection means for detecting a position of said sight pin relative to said housing;

display means for providing an indication of a range to a selected target; and control means operable to receive an indication of the position of said sight pin from said detection means, and operable to cause an associated indication of the range to be displayed on said display means based on a detected difference in position of the indicated sight pin position and a stored association of a first sight pin position and a first range.

2. The sight of claim 1, wherein the position of said sight pin relative to said housing is adjusted via an adjustment means.

3. The sight of claim 2 wherein the adjustment means comprises a flexible cable adapted to engage a screw.

4. The sight of claim 3 further comprising a flexible cable holder and a knob.

5. The sight of claim 1, wherein the stored association is user-defined.

6. The sight of claim 1, wherein the position of said sight pin relative to said housing is continuously adjustable.

7. The sight of claim 6, wherein a control means includes a stored association of at least one sight pin position with a corresponding range, and wherein said control means is operable to cause said display means to provide an indication of a corresponding range for each position of said sight pin relative to the housing.

8. The sight of claim 1 consisting of a single sight pin.

9. A programmable bow sight comprising:

control means having a first stored association between a first position of an adjustable sighting element and a first range to a target;

detecting means for detecting the position of the adjustable sighting element; and display means for indicating a range associated with a detected position of said sighting element, wherein said control means causes said display means to indicate the range associated with the detected position of said sighting element based on the first stored association between the first position of the sighting element and the first range.

10. The programmable bow sight of claim 9, wherein the detected position is substantially the first position, and wherein the range associated with the detected position is substantially the first range.

11. The programmable bow sight of claim 9, wherein the detected position is substantially different than the first position, and wherein the range associated with the detected position is determined based on a difference between the detected position and the first position.

12. The programmable bow sight of claim 9, wherein said sighting element is substantially continuously adjustable.

13. The programmable bow sight of claim 12, wherein said control means further comprises a second stored association between a second position of said sighting element and a second range.

14. The programmable bow sight of claim 12, wherein the detected position of said sighting element is detected via a linear position sensor operable with means for adjusting a position of said sighting element relative to said housing and said control means.

15. The programmable bow sight of claim 14, wherein said control means is operable to determine the detected position of said sighting element based on an output of said linear position sensor.

16. The programmable bow sight of claim 9, wherein said control means is programmable to at least one of disassociate the first position of said sighting element and the first range, and associate a second position of said sighting element with the first range.

17. The programmable bow sight of claim 9 consisting of a single sight element.

18. The programmable bow sight of claim 9 wherein the sighting element is adjusted by an adjustment means comprising a flexible cable adapted to engage a screw.

19. The programmable bow sight of claim 18 further comprising a flexible cable holder and a knob.

* * * * *